US008151721B2

(12) United States Patent
Tseng

(10) Patent No.: US 8,151,721 B2
(45) Date of Patent: Apr. 10, 2012

(54) THREAD TENSIONING DEVICE FOR A SEWING MACHINE

(76) Inventor: Hsien-Chang Tseng, Ta-Li (TW)

( * ) Notice: Subject to any disclaimer, the term of this patent is extended or adjusted under 35 U.S.C. 154(b) by 430 days.

(21) Appl. No.: 12/479,815

(22) Filed: Jun. 7, 2009

(65) Prior Publication Data

US 2010/0307399 A1 Dec. 9, 2010

(51) Int. Cl.
*D05B 47/00* (2006.01)

(52) U.S. Cl. ..... 112/254

(58) Field of Classification Search ..... 112/254, 112/255, 302, 253, 278, 273
See application file for complete search history.

(56) References Cited

U.S. PATENT DOCUMENTS 3,565,027 A * 2/1971 Miller et al. ..... 112/255
5,573,192 A * 11/1996 Tseng ..... 242/150 R
7,430,973 B2 * 10/2008 Wakazono ..... 112/254
7,536,963 B2 * 5/2009 Durville et al. ..... 112/302

* cited by examiner

*Primary Examiner* — Tejash Patel

(57) ABSTRACT

A thread tensioning device for a sewing machine comprises a limit member fixed on the sewing machine, and an elastic pulling member mounted on the limit member. The pulling member includes an elastic extension portion which is movably disposed on the limit member. The pulling member further includes a free end formed with a hook-shaped thread pulling portion. The limit member is provided with two limit portions defining a space for passage of the thread. During a thread loosening operation, the thread will be moved within the space defined by the two limit portions while being pulled by the thread pulling portion of the pulling member, so that the thread pulling portion can provide a proper amount of tension to the thread timely, thus avoiding the occurrence of skip stitch and ensuring the sewing quality.

17 Claims, 5 Drawing Sheets

THREAD TENSIONING DEVICE FOR A SEWING MACHINE

BACKGROUND OF THE INVENTION

1. Field of the Invention

The present invention relates to a thread tensioning device for a sewing machine which can provide effective tension timely to the thread during a thread loosening process to avoid the occurrence of skip stitch while effectively improving the sewing quality.

2. Description of the Prior Art

In order to provide a proper amount of tension to the thread while the thread hook loosens the thread, a sewing machine is normally provided with a spring structure which is disposed on the moving path of the thread to keep pressing against the thread. However, the above conventional structure has the following drawbacks: when the thread is pulled, the deformation of the spring is greatly increased, at this movement, the tension is too great, which will produce too much tension on the thread during a thread loosening operation, and thus the thread is likely to be broken. When the thread loosening operation is finished, the deformation of the spring is reduced, but the spring still keeps pressing against the thread with a certain amount of elastic force, so that an elastic tension still exists even when the thread doesn't need tension. As a result of this, when being pulled, the thread will also be broken due to an instant overlarge tension. In addition, although the spring is used to press against the thread to provide tension to it the tension of the thread is often either too great or too small, so it is difficult to perform the thread hooking operation assuredly during the thread loosening operation, thus causing the occurrence of skip stitch and needing improvement.

Further, when the thread is broken, since one end of the spring is provided with a hook which has poor sealing capability, the thread is likely to disengage from the hook. Further, it is also inconvenient to put it back into the spring once the thread is fallen out of the hook of the spring. Moreover, in order to control the change direction of the elastic force of the spring, the spring must be additionally provided with a framing structure to keep the deformation of the spring in a certain direction, thus inevitably increasing the structure complexity. In some other thread tensioning devices, the spring is totally replaced by a linkage cam, so that when the thread is pulled or loosened, due to the rotation of the cam, the thread can truly and selectively be kept in a tensioned state in a predetermined process and in a non-tensioned state in other processes. This structure is excessively complicated, so not only the production cost is higher, but the maintenance cost is also higher.

The present invention has arisen to mitigate and/or obviate the afore-described disadvantages.

SUMMARY OF THE INVENTION

The primary objective of the present invention is to provide a thread tensioning device for a sewing machine which is disposed on a moving path of the thread of the sewing machine. The thread tensioning device of the present invention is provided with a limit member and a pulling member mounted on the limit member. During a thread loosening operation, with an elastic extension portion and a thread pulling portion of the pulling member, and limit portions disposed on the limit member for limiting the movement of the thread, the thread tensioning device of the present invention can provide a proper amount of tension timely to the thread to allow the thread to be pulled by the thread hook and keep them in the optimal cooperation state, thus improving the sewing quality.

The secondary objective of the present invention is to provide a thread tensioning device for a sewing machine which is simple in structure. The thread tensioning device for a sewing machine is provided with a limit member and an elastic pulling member that cooperate with each other. Since the limit member guides the pulling member to elastically move in a certain direction and limits the travel of the thread, the thread tensioning device for a sewing machine of the present invention which has simple structure can provide effective tension to the thread, thus reducing the production cost.

The third objective of the present invention is to provide a thread tensioning device for a sewing machine which can facilitate installation of the thread by forming an open type thread guide portion on a free end of the limit member in such a manner that the thread can be effectively and quickly placed in a travel limit space defined by the limit member and limited therein.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
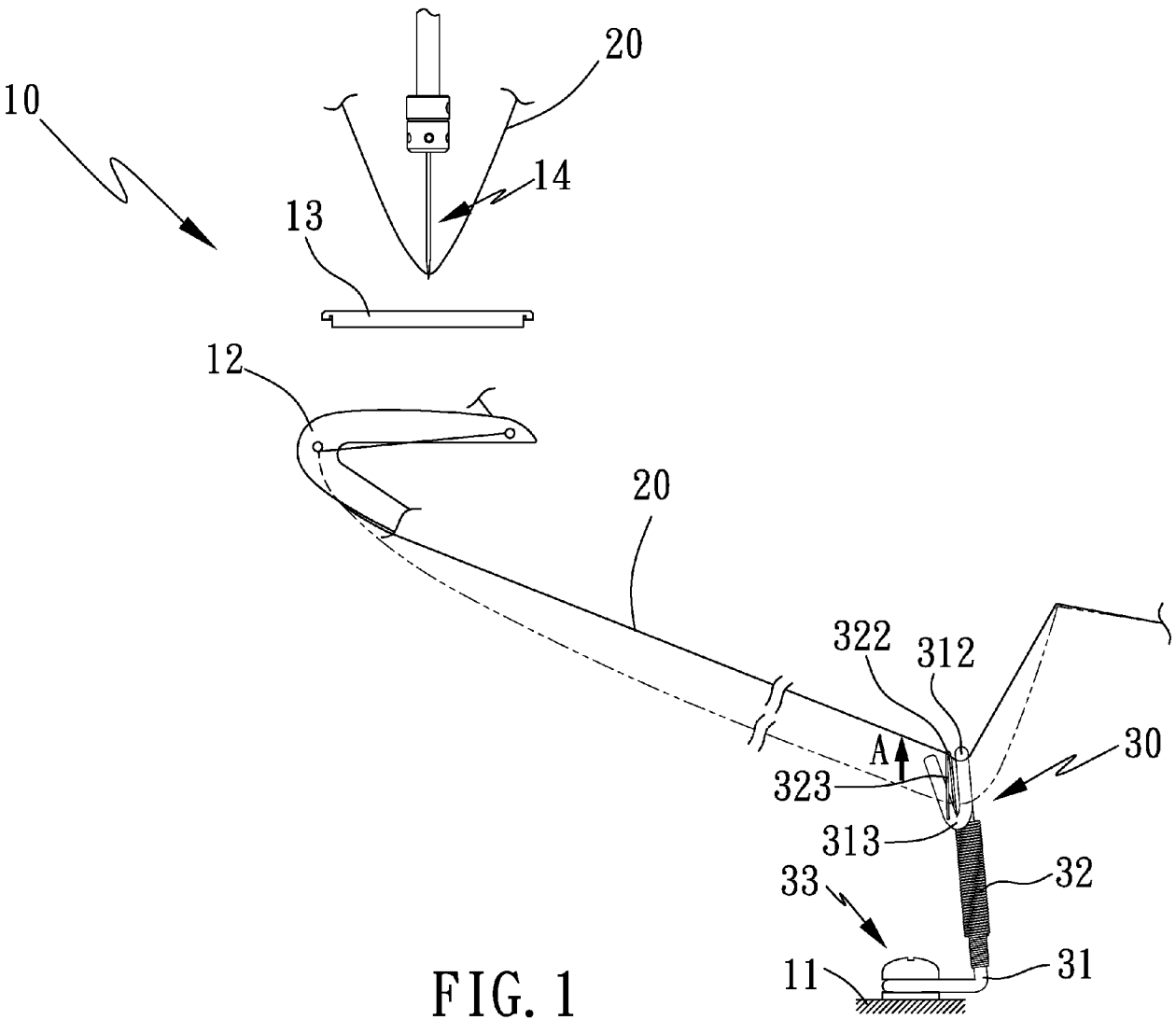
FIG. 1 is an operational view showing that how a thread hook cooperates with a thread tensioning device for a sewing machine in accordance with the present invention to maintain the thread in a tensioned state.

Referring to FIG. 1, a sewing machine 10 includes a base 11. In the base 11 is provided a thread hook 12. A needle plate 13 is disposed above the thread hook 12 for insertion of a needle 14 to cooperate with the thread hook 12 in such a manner that the thread hook 12 is used to hook the thread 20 of the needle 14 to carry out a sewing operation. Further, on a moving path of the thread 20 driven by the thread hook 12 is provided a thread tensioning device 30 for timely providing a proper amount of tension to the thread 20 to improve the sewing quality.

Figure 2:
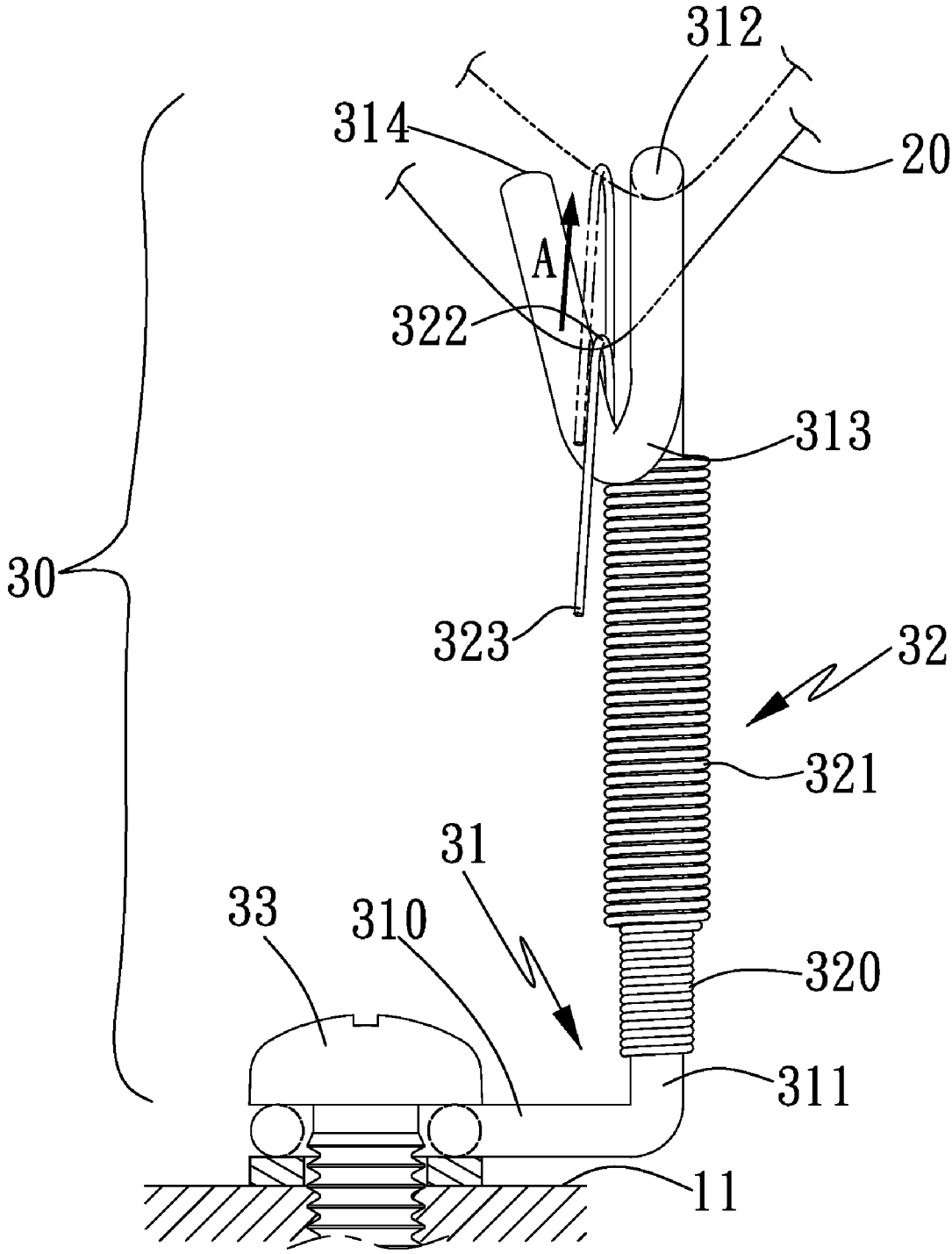
FIG. 2 is a front view of the thread tensioning device for a sewing machine in accordance with the present invention.
Figure 3:
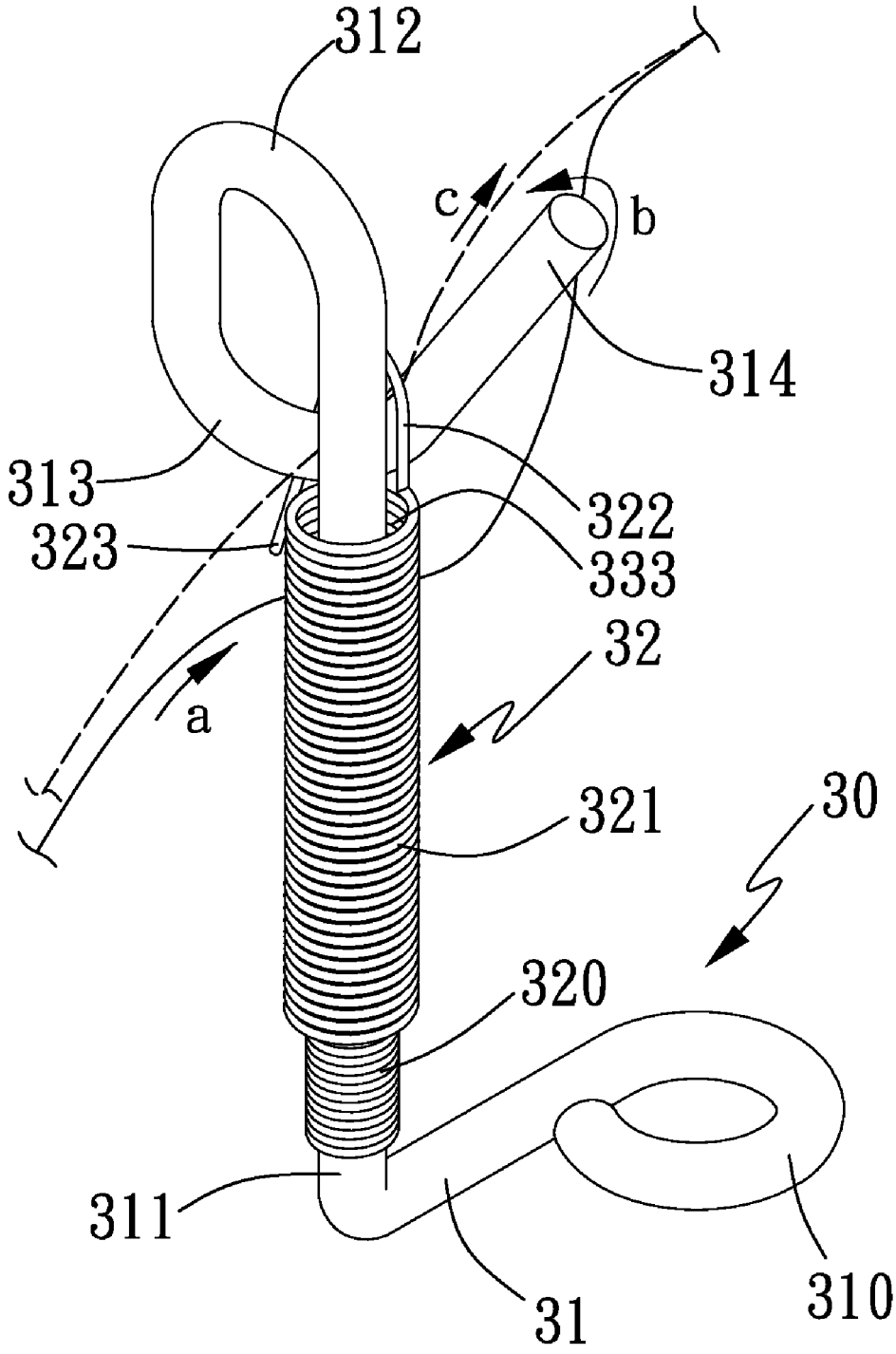
FIG. 3 is an operational view showing how the thread is disposed in the thread tensioning device for a sewing machine in accordance with the present invention.

Further referring to FIGS. 2 and 3, the thread tensioning device 30 for a sewing machine in accordance with the present invention comprises a limit member 31 fixed on the base 11 of the sewing machine 10. On the limit member 31 is further mounted a pulling member 32 for pulling the thread 20 inserted therethrough. The limit member 31 is a bent rod and includes a horizontal circular fixing portion 310 at a bottom thereof. A fixing member 33 in the form of a bolt is inserted through the fixing portion 310 and then screwed into the base 11 to fix the limit member 31 on the base 11.

The limit member 31 further includes a rod-shaped guide portion 311, a first limit portion 312, a second limit portion 313 and a thread guide portion 314. The guide portion 311 vertically extends from the fixing portion 310. The extending direction of the guide portion 311 is the same as the moving direction a of the thread 20. The pulling member 32 is mounted on the guide portion 311. The guide portion 311 is inserted through and extends upward out of the pulling member 32 to the top end of the travel path of the thread 20 and is then bent reversely to form the first limit portion 312. As shown in FIG. 3, the first limit portion 312 extends downwards to the bottom end of the travel path of the thread 20 and is then bent reversely to form a second limit portion 313. A thread guide portion 314 extends from the second limit portion 313 and is in the form of a free end and spaced apart from the guide portion 311 to define a space with respect to the guide portion 311 for passage of the thread 20. The first and the second limit portions are located at the top and the bottom ends of the travel path of the travel of the thread, respectively.

The pulling member 32 is an extension coil spring and includes a smaller-diameter tightening end 320 with an inner diameter equal to or slightly smaller than an outer diameter of the guide portion 311 in such a manner that the pulling member 32 can be positioned on guide portion 311 by its elastic force. Further, the pulling member 32 can axially move along the guide portion 311 to adjust the tension applied by the pulling member 32 to the thread 20 and to adjust the position at which the thread is to be pulled.

The pulling member 32 further includes a bigger-diameter elastic extension portion 321 extending from the tightening end 320, and a hook-shaped thread pulling portion 322 extending from the elastic extension portion 321 towards the first limit portion 312 and the second limit portion 313 of the limit member 31. The elastic extension portion 321 is larger in diameter than the guide portion 311 so that an elastic clearance 333 is formed between the elastic extension portion 321 and the guide portion 311 after the elastic extension portion 321 is sleeved on the guide portion 311, as shown in FIG. 3. The thread pulling portion 322 includes a thread limit end 323 that is bent downwards and straddles the second limit portion 313. The thread limit end 323 is slightly longer than a distance between the first limit portion 312 and the second limit portion 313, so that when the thread pulling portion 322 is pulled by the thread 20, the elastic extension portion 321 will be caused to deform in axial direction of the guide portion 311 or to deviate horizontally, and as a result, the thread pulling portion 322 will be caused to move between the first limit portion 312 and the second limit portion 313, the thread pulling portion 322 can be ensured to straddle the second limit portion 313, and the thread 20 can be prevented from disengaging from the thread limit end 323 when in a loosened state.

Referring to FIG. 3, the thread 20 can be put in the thread tensioning device 30 of the present invention without being cut off in such a manner that the portion of the thread 20 lies along the path a under the second limit portion 313 of the limit member 31 after falling out of the thread tensioning device 30 is pulled over the thread guide portion 314 along the direction b from the lower portion of the second limit portion 313 and finally into the space c between the first limit portion 312 and the second limit portion 313. At the same time, the thread 20 enters the opening of the thread pulling portion 322 of the pulling member 32 and is located between the second limit portion 313 and the thread pulling portion 322.

Figure 4:
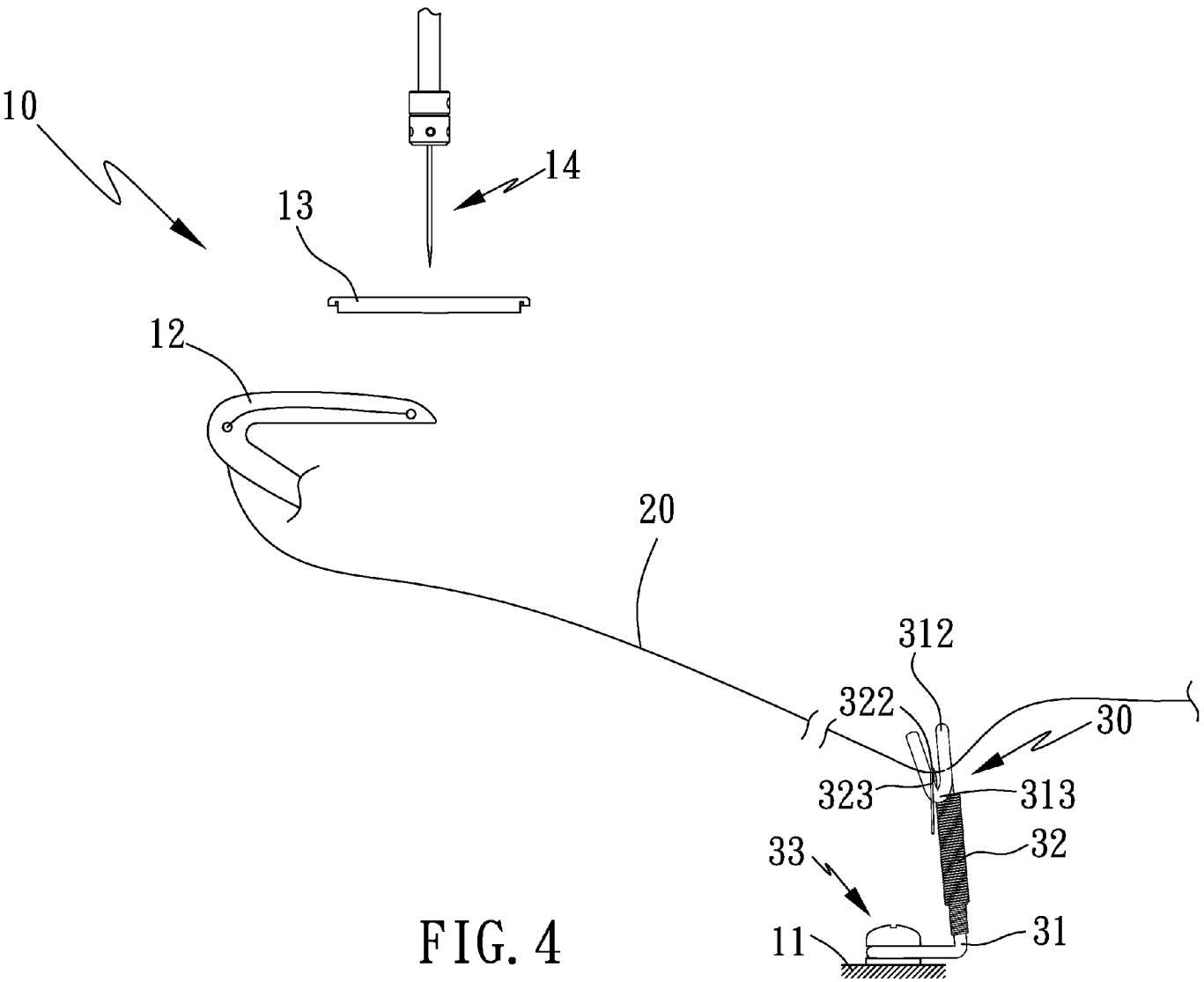
FIG. 4 is an operational view showing that how the thread hook cooperates with a thread tensioning device for a sewing machine in accordance with the present invention to maintain the thread in a non-tensioned state.

When the thread hook 12 of the sewing machine 10 is operated to loosen the thread 20, since the thread pulling portion 322 of the pulling member 32 is slightly higher than the second limit portion 313, the thread 20 can be moved between the first limit portion 312 and the second limit portion 313 without being pulled by the thread pulling portion 322. Therefore, the thread 20 is in the non-tensioned state and can pass through the thread tensioning device 30 quickly without being subjected to any resistance, predetermined fore or pressure. When the thread hook 12 moves right to the position as shown in FIG. 1 while pulling the thread 20 tight, the thread 20 will be pulled towards the first limit portion 312, from this moment, the thread 20 begins to be pulled by the thread pulling portion 322. While the thread pulling portion 322 is pulling the thread 20, a proper amount of tension will be applied to the thread 20 through the tensile deformation of the thread pulling member 32. By such arrangements, during a thread loosening operation, namely during the movement of the thread hook 12 from the position shown in FIG. 1 to the position shown in FIG. 4, the thread pulling portion 322 keeps pulling the thread 20 with an appropriate amount of tension, so that when the needle 14 comes in, the thread 20 is maintained in an optimally tensioned state, thus improving the sewing quality while reducing the occurrence of skip stitch.

Figure 6:
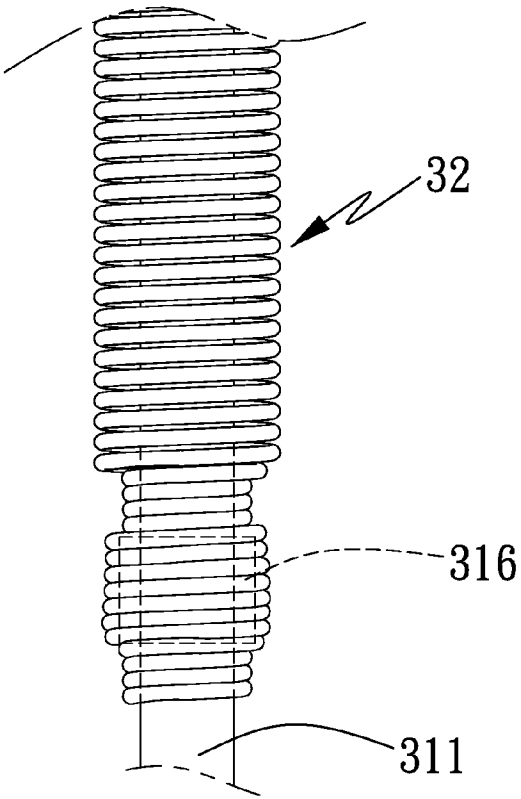
FIG. 6 is a schematic view showing another limit member which is provided with a positioning member in accordance with the present invention.
Figure 5:
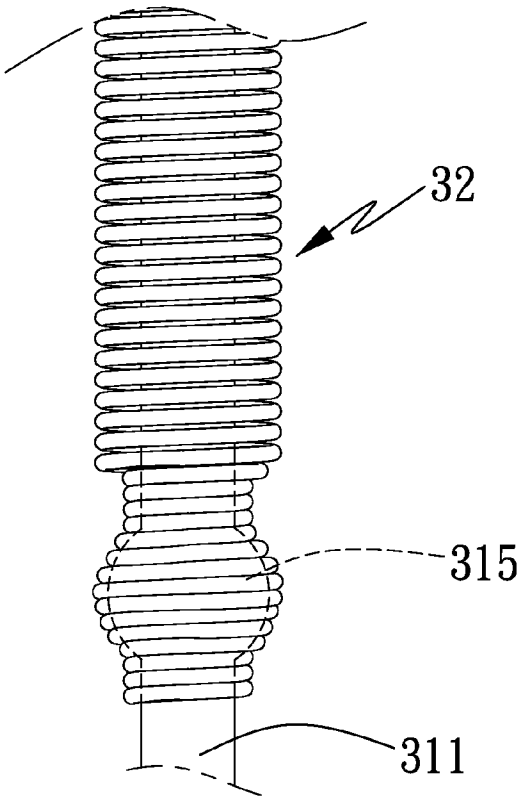
FIG. 5 is a schematic view showing a limit member in accordance with the present invention.

Additionally, the pulling member 32 and the limit member 31 of the present invention can also be combined in such a manner as shown in FIG. 5 that the guide portion 311 of the limit member 31 is provided with a flat wing-shaped positioning portion 315 for positioning the end of the pulling member 32. In addition, as shown in FIG. 6, the guide portion 311 of the limit member 31 can also be provided with a cylindrical positioning member 316 for positioning the end of the pulling member 32.

With the above structure design, the present invention has the following functions:

1. Providing the required tension to the thread 20 substantially: since the tightening end 320 of the pulling member 32 is tightened on the guide portion 311 in such a manner that the pulling member 32 can be axially moved along the guide portion 311 of the limit member 31 to change the position of the thread pulling portion 322 of the pulling member 32, the thread pulling portion 322 can pull the thread if necessary to apply a proper tension to the thread 20 to improve the sewing quality.

2. Convenient to adjust: since the tightening end 320 of the pulling member 32 is elastically tightened on the guide portion 311, the pulling member 32 can be directly moved in an elastic manner, thus achieving the objective of convenient and quick movement.

3. Simple in structure: since the overall structure of the thread tensioning device present invention is fixed through a cooperation of a fixing portion 310 and a fixing member 33, and the pulling member 32 and the limit member 31 are simple in structure and assembled in an engaging manner, the thread tensioning device of the present invention is quick and convenient to assemble.

4. It is quick and simple to install the thread 20: the installation of the thread 20 is finished with only one step that is pulling the thread over the thread limit end 323 without any complicated thread inserting operation.

5. The travel path of the thread 20 can be effectively controlled: the thread 20 is limited by the second limit portion 313, the first limit portion 312 and the thread pulling portion 322 at the same time, so that when being pulled to the highest point of its travel path, the thread 20 will be limited by the first limit portion 312 to keep the tension thereof within a certain range without causing overlarge tension due to excessive pull on the thread 20, thus ensuring an even sewing force and improving the sewing quality.

While we have shown and described various embodiments in accordance with the present invention, it is clear to those skilled in the art that further embodiments may be made without departing from the scope of the present invention.

The invention claimed is:

1. A thread tensioning device for a sewing machine comprising:

a limit member being fixed on the sewing machine and provided with a pulling member thereon for pulling a thread inserted through the pulling member; wherein:

the limit member is provided with a rod-shaped guide portion;

the pulling member is an extension coil spring, the pulling member is positioned on the guide portion and provided with an elastic extension portion which is mounted on the guide portion in such a manner that the elastic extension portion is larger in diameter than the guide portion so as to define an elastic clearance between the elastic extension portion and the guide portion when the pulling member elastic extension portion is sleeved on the guide portion, the elastic extension portion is provided with a thread pulling portion at one end thereof;

the thread is pulled by the thread pulling portion in such a manner that an axial elastic deformation of the elastic extension portion is caused when the thread is pulled and the deformation provides a tension to the thread.

2. The thread tensioning device for a sewing machine as claimed in claim 1, wherein the limit member is a bent rod and includes a fixing portion at a bottom thereof, a fixing member is inserted through the fixing portion to fix the limit member on the sewing machine.

3. The thread tensioning device for a sewing machine as claimed in claim 1, wherein the limit member is bent at a top end and a bottom end of a travel path of the thread to form a first limit portion and a second limit portion, respectively, at a free end of the second limit portion is formed a thread guide portion which is spaced apart from the guide portion to define a space with respect to the guide portion.

4. The thread tensioning device for a sewing machine as claimed in claim 3, wherein the pulling member includes a tightening end having an inner diameter equal to or smaller than an outer diameter of the guide portion, the elastic extension portion of the pulling member extends from the tightening end and has an inner diameter bigger than the outer diameter of the guide portion, the thread pulling portion is hook-shaped and extends toward the first limit portion and the second limit portion.

5. The thread tensioning device for a sewing machine as claimed in claim 3, wherein the pulling member includes a tightening end positioned on the guide portion, the elastic extension portion is located between the tightening end and the thread pulling portion, the thread pulling portion is hook-shaped and extends towards the first limit portion and the second limit portion.

6. The thread tensioning device for a sewing machine as claimed in claim 3, wherein the thread pulling portion is provided with a thread limit end longer than a distance between the first limit portion and the second limit portion.

7. The thread tensioning device for a sewing machine as claimed in claim 1, wherein the pulling member includes a tightening end having an inner diameter equal to or smaller than an outer diameter of the guide portion, the elastic extension portion of the pulling member extends from the tightening end and has an inner diameter bigger than the outer diameter of the guide portion, the thread pulling portion is hook-shaped and extends toward the first limit portion and the second limit portion.

8. The thread tensioning device for a sewing machine as claimed in claim 1, wherein the pulling member includes a tightening end positioned on the guide portion, the elastic extension portion is located between the tightening end and the thread pulling portion, the thread pulling portion is hook-shaped and extends towards the first limit portion and the second limit portion.

9. The thread tensioning device for a sewing machine as claimed in claim 1, wherein the guide portion is additionally provided with a wing-shaped positioning portion for positioning the pulling member.

10. The thread tensioning device for a sewing machine as claimed in claim 1, wherein the guide portion is provided with a positioning member for positioning the pulling member.

11. A thread tensioning device for a sewing machine comprising:

a limit member being fixed on the sewing machine and provided with a first limit portion and second limit portion that define a space for passage of a thread, the first limit portion and the second limit portion being located at ends of a travel path of the thread, respectively; and a pulling member being an extension coil spring, one end of the pulling member being fixed on the sewing machine, and the other end of the pulling member including an elastic extension portion, the elastic extension portion being provided with a thread pulling portion straddling the second limit portion and pulling the thread, the thread pulling portion being provided with a thread limit end for limiting a movement of the thread pulling portion between the first and the second limit portions; wherein:

the thread is pulled by the thread pulling portion, and the thread pulling portion is allowed to move between the first and the second limit portions in such a manner that an axial elastic deformation or horizontal deviation of the elastic extension portion are caused when the thread is pulled and the deformation and deviation provide a tension to the thread.

12. The thread tensioning device for a sewing machine as claimed in claim 11, wherein the limit member is provided with a rod-shaped guide portion, the pulling member is positioned on the guide portion, the elastic extension portion is mounted on the guide portion in such a manner that the elastic extension portion is larger in diameter than the guide portion so as to define an elastic clearance between the elastic extension portion and the guide portion when the pulling member elastic extension portion is sleeved on the guide portion, the thread is pulled by the thread pulling portion in such a manner that an axial elastic deformation of the elastic extension portion is caused when the thread is pulled and the deformation provides the tension to the thread.

13. The thread tensioning device for a sewing machine as claimed in claim 11, wherein the limit member is a bent rod and includes a fixing portion at a bottom thereof, a fixing member is inserted through the fixing portion to fix the limit member on the sewing machine.

14. The thread tensioning device for a sewing machine as claimed in claim 11, wherein the limit member is bent at a top end and a bottom end of the travel path of the thread to form the first limit portion and the second limit portion, respectively, at a free end of the second limit portion is formed a thread guide portion which is spaced apart from the guide portion to define a space with respect to the guide portion.

15. The thread tensioning device for a sewing machine as claimed in claim 11, wherein the pulling member includes a tightening end having an inner diameter equal to or smaller than an outer diameter of the guide portion, the elastic extension portion of the pulling member extends from the tightening end and has an inner diameter bigger than the outer diameter of the guide portion, the thread pulling portion is hook-shaped and extends toward the first limit portion and the second limit portion.

16. The thread tensioning device for a sewing machine as claimed in claim 11, wherein the pulling member includes a tightening end positioned on the guide portion, the elastic extension portion is located between the tightening end and the thread pulling portion, the thread pulling portion is hook-shaped and extends towards the first limit portion and the second limit portion.

17. The thread tensioning device for a sewing machine as claimed in claim 11, wherein the thread limit end is longer than a distance between the first limit portion and the second limit portion.

* * * * *